United States Patent [19]

Burke et al.

[11] Patent Number: 4,588,344

[45] Date of Patent: May 13, 1986

[54] ROLL TRANSFER ROBOT

[75] Inventors: Steven A. Burke, New Haven; Christopher Pali, Fort Wayne, both of Ind.

[73] Assignee: Essex Group, Inc., Fort Wayne, Ind.

[21] Appl. No.: 617,300

[22] Filed: Jun. 4, 1984

[51] Int. Cl.[4] ..... B65H 1/00

[52] U.S. Cl. ..... 414/225; 414/751; 414/786; 242/58.6

[58] Field of Search ..... 414/730, 750, 749, 751, 414/222, 223, 225, 786, 16, DIG. 910; 198/376; 901/17, 14, 16, 30, 31, 32, 36, 37, 38, 39; 242/58.6, 79

[56] References Cited

U.S. PATENT DOCUMENTS

| | | | |
|---|---|---|---|
| 3,202,449 | 8/1965 | Lemelson | 901/38 X |
| 3,306,442 | 2/1967 | Devol | 901/32 X |
| 3,580,380 | 5/1971 | Phillips | 198/376 |
| 3,582,010 | 6/1971 | Whiteman | 242/58 |
| 3,645,463 | 2/1972 | Helm | 242/58.1 |
| 4,219,171 | 8/1980 | Rudmann | 901/31 X |
| 4,479,673 | 10/1984 | Inaba et al. | 901/39 X |

FOREIGN PATENT DOCUMENTS

| | | | |
|---|---|---|---|
| 962043 | 2/1975 | Canada | 901/14 |
| 2936967 | 4/1981 | Fed. Rep. of Germany | 414/749 |
| 52-15061 | 4/1977 | Japan | 414/749 |
| 603577 | 4/1978 | U.S.S.R. | 901/16 |

*Primary Examiner*—Robert J. Spar
*Assistant Examiner*—Dennis Williamson
*Attorney, Agent, or Firm*—Robert P. Hayter

[57] ABSTRACT

A roll transfer robot and method of operation are disclosed wherein a roll transfer robot acts to move a roll of material from a conveyor assembly to a payoff assembly. The roll transfer robot assembly is capable of translational motion between the two assemblies. In addition the roll transfer robot includes a spindle assembly capable of both sliding and rotational displacement. Detectors are additionally provided as part of the robot assembly for identifying the rotational position of the roll being mounted to the payoff assembly.

9 Claims, 7 Drawing Figures

FIG. 5
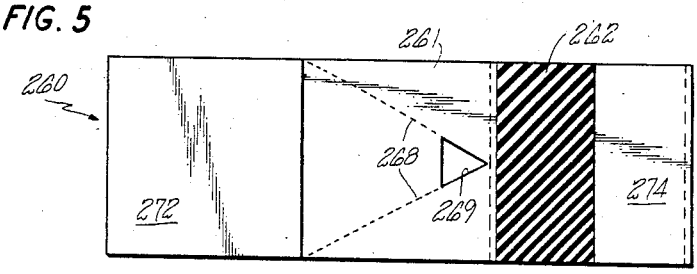
FIG. 6
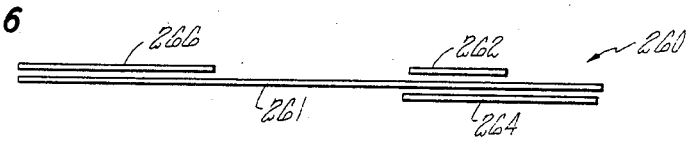
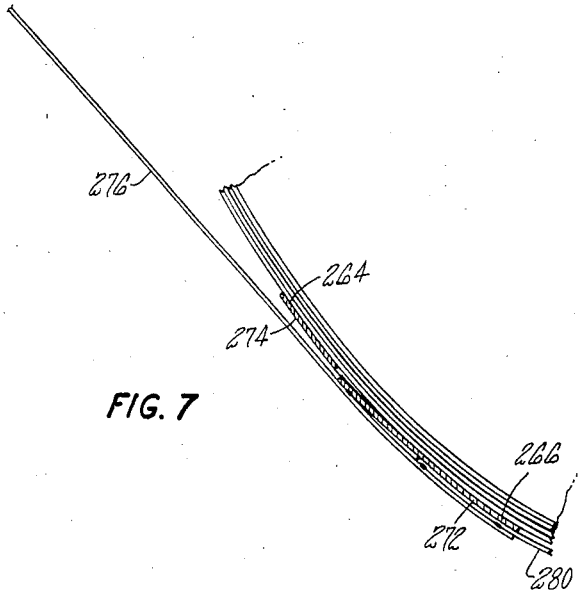
FIG. 7

ROLL TRANSFER ROBOT

BACKGROUND OF THE INVENTION

The present invention relates to a roll transfer robot for transferring a roll of ribbon material. More specifically the present invention concerns a robot capable of removing a roll of ribbon material from a conveyor means and placing that roll of ribbon material onto a chuck of a ribbon payoff assembly with lead end located and rotated to a predetermined position.

In the area of providing continuous ribbon material to a process use it has been known to unwind a reel of material and to join the end of one roll of material to the next roll of material such that a continuous supply of ribbon is provided to the end use. Such previous systems have included mounting multiple rolls adjacent one another and upon a depletion of one roll manually mounting another roll.

The herein described apparatus and method is concerned with a ribbon payoff assembly capable of unwinding one roll at a time and a robot capable of replacing that roll as soon as it is unwound. The robot acts to transfer a roll of material from a conveyor assembly having a multiplicity of rolls of material thereon to a payoff assembly. The entire paper or ribbon supply system is designed to operate at very high speeds such that a new roll is required every four to nine minutes. The robot assembly is designed to supply a roll to the payoff assembly within this time interval. Hence, by utilizing this assembly it is not necessary to have a full time attendant for loading paper rolls onto the payoff assembly.

SUMMARY OF THE INVENTION

It is an object of the present invention to provide a roll transfer robot for transporting a roll of material.

It is a further object of the present invention to provide a roll transfer robot capable of removing a roll of ribbon material from a conveyor means and placing that roll of material onto a payoff assembly.

It is a yet further object of the present invention to provide a robot assembly capable of translational movement between a conveyor means and a payoff assembly, sliding movement between a pick-up position from the conveyor means and an at-rest position, between a position for mounting the paper to the payoff assembly and an at-rest position and being capable of rotating the paper roll to the desired position.

It is a still further object of the present invention to provide a method for removing the paper roll from the conveyor means and transporting that roll to the payoff assembly.

It is another object of the current invention to provide a method and apparatus for aligning the paper roll in a desired rotational orientation based upon a mark on the exterior surface of the paper roll.

It is a further object of the herein invention to provide an automatic safe, reliable, economical, easy to maintain and service roll transfer robot.

Other objects will be apparent from the description to follow and the appended claims.

The above objects are achieved according to a preferred embodiment of the present invention by the provision of a roll transfer robot for transferring a roll of paper ribbon material having an outside diameter and an annular core from an unloading position of a conveyor assembly to a chuck means of a payoff assembly. The roll transfer robot includes frame means supporting a spindle assembly for both rotational and sliding displacement, locomotion means for displacing the robot between a first position in registration with the unloading position of the conveyor assembly and a second position in registration with the chuck means of the payoff assembly, rotating means connected to the spindle assembly for effecting rotation thereof, sliding means connected to the spindle assembly for effecting sliding displacement of the spindle assembly relative to the frame means and means connected to the spindle assembly releasably gripping the roll about its exterior diameter such that the paper roll may be rotated and slidably displaced with the spindle assembly.

Additionally disclosed is a method of transferring a roll including an annular core from an unloading position of a conveyor assembly to a chuck means of a payoff assembly utilizing a robot assembly having adjustable roll clamping jaws. The steps include positioning the robot assembly in registration with the unloading position of the conveyor assembly, gripping the roll with the roll clamping jaws, removing the roll from the conveyor assembly, repositioning the robot assembly in registration with the payoff assembly, rotating the clamping jaws to rotate the roll into a desired orientation, placing the roll in position for the chuck of the payoff assembly to engage the roll core, holding the roll with the paster tab in a predetermined position until the paster cycle is complete and releasing the roll clamping jaws to release the roll.

BRIEF DESCRIPTION OF THE DRAWINGS

FIG. 5 is a top view of the paster tab.

FIG. 6 is a side view of the paster tab.

FIG. 7 is a side view of the paster tab engaging an expiring ribbon with the lead end of a new ribbon.

DESCRIPTION OF THE PREFERRED EMBODIMENT

Figure 1:
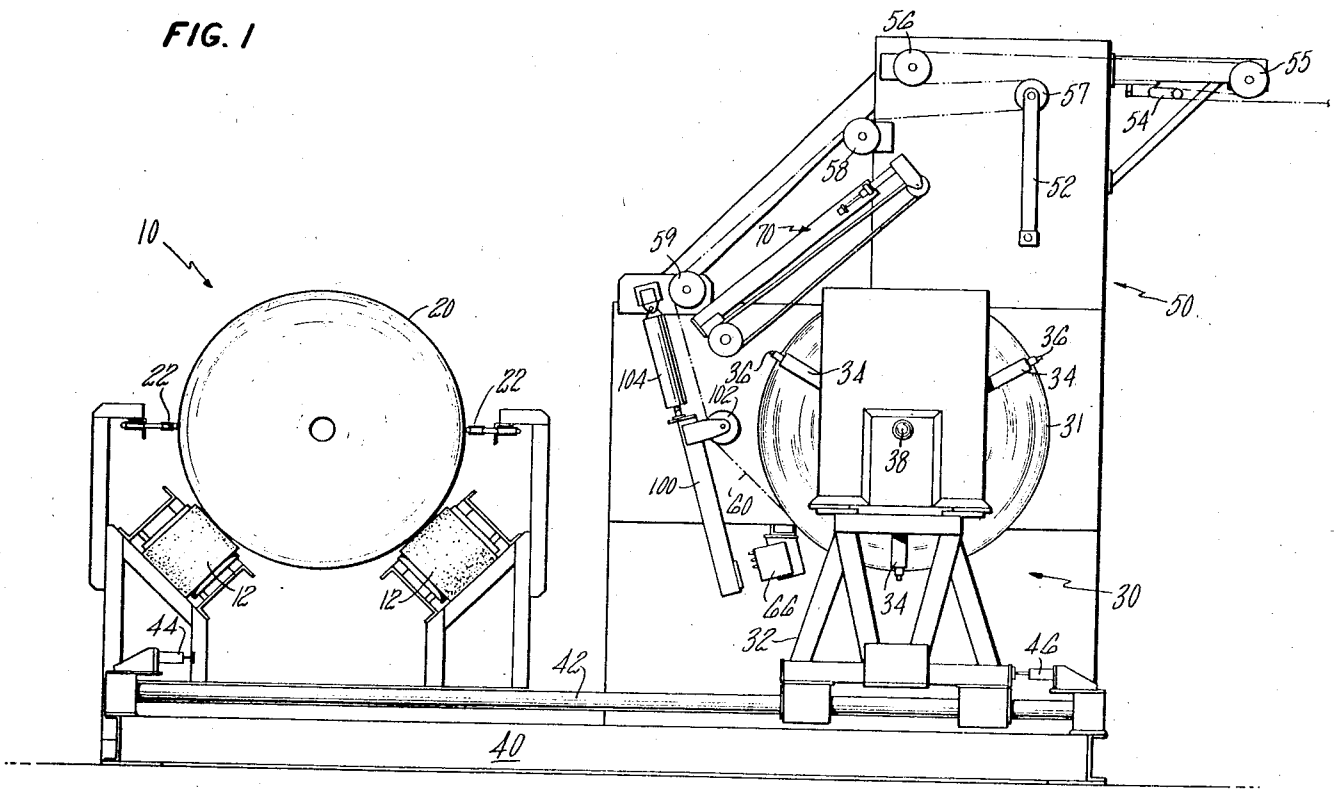
FIG. 1 is a front view of the conveyor assembly, robot assembly and paper payoff assembly.
Figure 2:
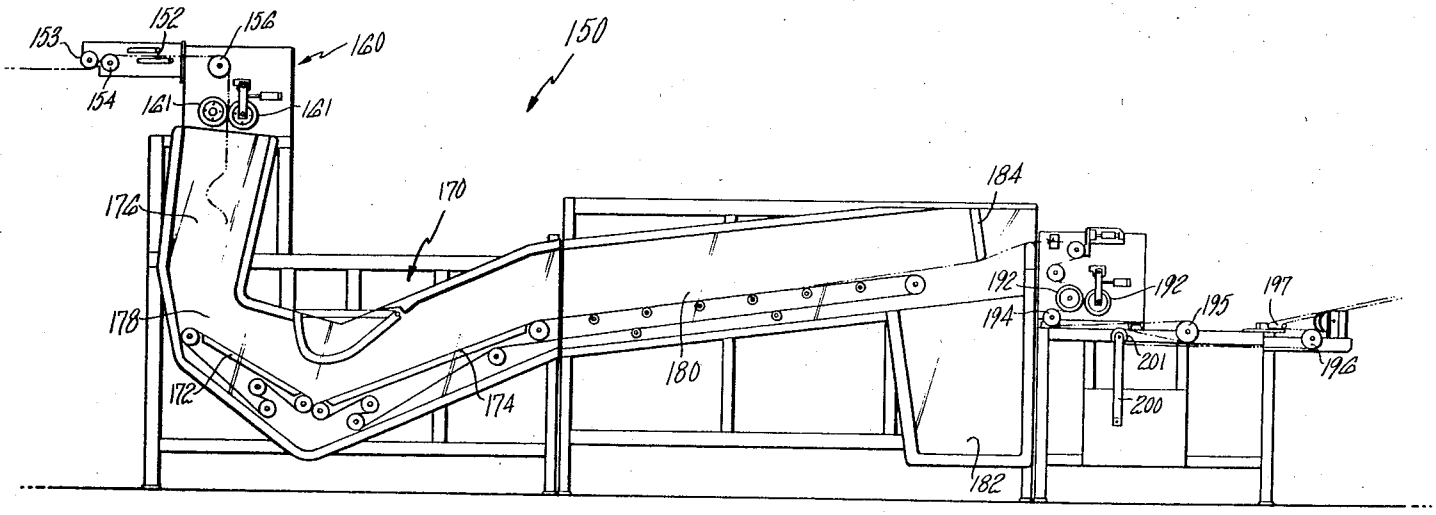
FIG. 2 is a front view of the ribbon feeder and accumulator assembly and feed-up assembly.
Figure 3:
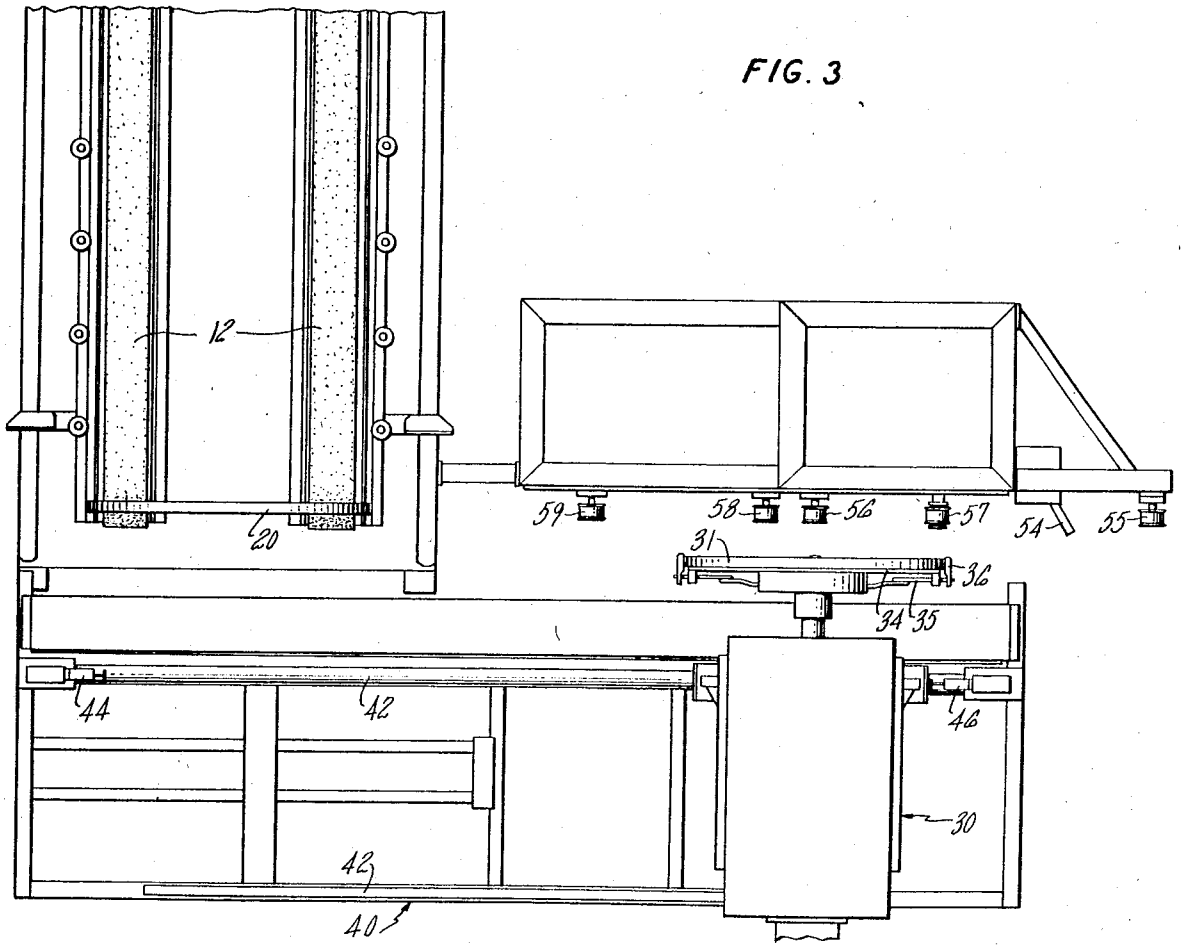
FIG. 3 is a plan view of the conveyor assembly, robot assembly and payoff assembly.

Referring to FIGS. 1–3 there may be seen a front view and a partial top view of a complete ribbon feed system for supplying paper ribbon from large rolls of ribbon to an end use at a high rate of speed. It is anticipated that ribbon as required for a particular use may come in rolls up to three feet in diameter and may be of varying widths. The specific use for which the herein equipment was designed is to supply paper to a wire production facility. This paper ribbon typically has a width between one and one and a half inches. It is desirable to supply the paper at speeds in the 2,000–5,000 feet per minute range. This ribbon supply system could, of course, be used for other applications and with rolls of paper or other material of varying sizes.

Each paper roll of the dimensions mentioned contains approximately 17,000 lineal feet of paper. At the desired unwinding speeds an individual paper roll, is completely consumed in 4–9 minutes. The equipment herein is designed to allow another roll to be mounted automatically and joined to the previous roll such that the wire production facility may operate continuously including operating without interruption when paper rolls are being changed. Absent such automatic machinery it would be necessary to provide attendants for the purpose of loading paper rolls.

FIG. 1 is front view of a conveyor assembly, a paper payoff assembly and a robot assembly. Conveyor assembly 10 consists of two parallel mounted conveyor belts 12 having a series of paper rolls 20 stacked vertically therebetween. The length of the conveyor belts depends upon the number of paper rolls desired to be mounted on the conveyors at one time. The length is theoretically unlimited. The conveyor assembly includes means to advance the conveyor belts to move paper rolls 20 forward to a position where robot assembly 30 may grasp and remove the roll from the conveyor belts. Position sensors 22 are shown located one on either side of the paper roll to indicate that the upper roll has been advanced to a pickup position. The conveyor belts are typically operated to advance the paper rolls until the position sensors are tripped by contact with the paper roll.

Robot assembly 30 is mounted on rails 42 for left-to-right motion as seen in FIG. 1. A pneumatic motor, electrical motor or other device may be used to move the robot assembly. Position stops 44 and 46 are utilized to control the position of robot assembly 30. Robot assembly 30 includes arms 34 containing clamp jaw mechanisms 36 for securing paper roll 31. A central shaft for allowing rotation of the entire paper roll is further provided. The robot assembly may traverse to the left, mechanically grasp and remove a paper roll from the conveyor assembly, and thereafter traverse to the right until aligned with the paper payoff assembly. The robot assembly then acts to position the paper roll on paper payoff assembly 50.

Once the paper roll is on paper payoff assembly 50 paper ribbon 60 is directed over pulleys 102, 59, 58, 57, 56, and 55 serially. The ribbon then passes over angle bar 54 and continues to the ribbon feeder and accumulator assembly 150 of FIG. 2. Paper payoff assembly 50 further includes a paster arm assembly 100, glue applicator 66, drive belt assembly 70, and dancer arm 52. The paster arm assembly includes apparatus for holding and cutting the ribbon after a paper roll has been unwound. Glue applicator 66 is utilized to provide adhesive to the trail end of the consumed paper roll such that the trail end of the ribbon from the consumed paper roll may be connected to the beginning portion of the ribbon of the new roll mounted on the paper payoff assembly by the robot assembly.

Drive belt assembly 70 consists of a drive belt operated to rotate the paper roll at a desired speed to supply ribbon to the end use. The ribbon passes over pulley 57 which is mounted on dancer arm 52. The position of dancer arm 52 is used to control the speed of drive belt 70 for regulating the payoff rate of ribbon 60.

FIG. 3 is a plan view of FIG. 1 showing the relative positioning between the various elements. It may be seen that conveyor assembly 20 includes conveyor belts 12 extending whatever distance desired. Paper roll 20 is shown at the end of the conveyor assembly.

Robot assembly 30 is shown mounted for left-to-right movement on rails 42 of machine frame 40. Position stops 44 and 46 are shown for appropriately positioning the robot assembly.

Robot assembly 30 is additionally shown holding paper roll 31 with clamp jaws 36. Clamp jaw 36 are connected to drivers 35 for manipulating the jaws radially inwardly and outwardly. Arm 34 is shown for securing the driver and clamp jaw for sliding motion relative thereto. Pulleys 56 through 59 of the paper payoff assembly are additionally shown to indicate the relative positioning therebetween. Paper roll 31 shown clamped in the robot assembly is in position to be mounted on a core latch chuck of the paper payoff assembly. The robot assembly will advance the paper roll toward the top of FIG. 3 to place it in on the core latch chuck and in alignment with the pulleys indicated on the payoff assembly.

FIG. 2 is a front view of ribbon feeder and accumulator assembly 150. The ribbon feeder and accumulator assembly is utilized to store sufficient ribbon such that during the time interval between the consumption of one paper roll and the mounting of a new paper roll by the robot assembly, the process to which the paper is supplied may continue to operate with paper being continuously supplied from the ribbon feeder and accumulator assembly. To supply paper for this interval when no paper is being unwound, it is necessary to store a sufficient quantity of paper that operation of the end use may continue. Under the circumstances described it might be appropriate to store from 1,000–5,000 lineal feet of paper ribbon in the feeder and accumulator assembly.

The ribbon feeder and accumulator assembly 150 includes paper feeder 160 and paper accumulator 170 having feed chute 176, stacking area 178 and storage area 180. Ribbon is supplied through pulleys 153 and 154, through static eliminator 152 and around pulley 156 to feed wheels 160. Feed wheels 161 direct the ribbon into the stacking area and include urethane tire-like portions for effectively stiffening the ribbon such that it is directed in a straight path resulting in the ribbon being folded in large loops in the stacking area. Stacks of ribbon from the stacking area are conducted by ramp conveyor belt 172 downward and to the right. Storage conveyor belt 174 then directs the stacks of ribbon into storage area 180. The pack lean reversing shoe is positioned to create a resistance at the top portion of the folds such that as the folds of paper are switched from ramp conveyor belt 172 to storage conveyor belt 174 the direction of lean of the folds is reversed. Reversing the direction of lean of the paper in the storage area allows the paper to be removed from the storage area without pulling the paper from the bottom of the pack thereby reducing the force required to physically pull the paper from the storage area. Spill box 182 is utilized to store excess folds when inadvertently dumped thereinto. Fold stripper 184 acts to remove the folds from the paper.

The feed assembly includes supply wheels 192 for supplying paper to the end use at the line speed, pulleys 194, 195, 196, 197 and dancer 200 having pulley 201. The position of dancer 200 is sensed and thereafter used to trim the feed rate of wheels to provide constant tension in the paper ribbon for the end use. The remaining pulleys simply act to guide the paper through the feed-up assembly.

Figure 4:
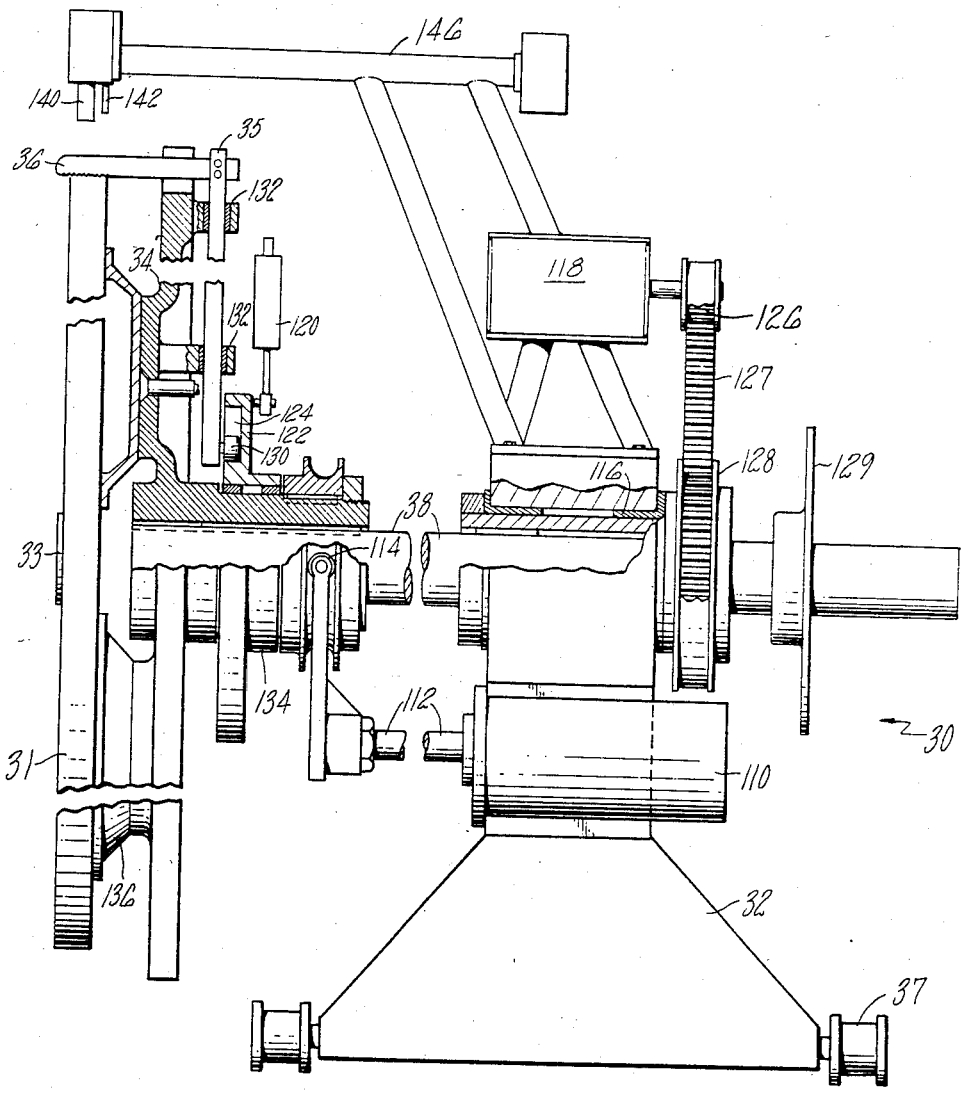
FIG. 4 is a partially sectional side view of the robot assembly.

FIG. 4 is a partially schematic, partially cutaway view of robot assembly 30. Paper roll 31 is shown mounted on the left-hand side of the robot assembly and includes paper core 33. The paper roll is secured in position via clamp jaw 36 connected to clamp jaw driver 35. Arm 34 extends outwardly from spindle 134 and includes a slide guide 132 for securing the clamp jaw driver 35 for relative sliding displacement therewith. Various-sized spacers 136 are utilized to provide the desired spacing between the arm and the paper roll. The size of the spacer may be adjusted depending upon the width of the paper roll being utilized. Although only one arm and clamp jaw is specifically shown more than one, such as three, may actually be utilized. Cam hub 122 is mounted on a portion of spindle 134 and is generally cylindrical in configuration. Cam hub 122 defines an inclined slot 124. Actuator 120 is provided for rotating the cam hub when it is desired to displace the clamp jaws either outwardly or inwardly. Cam follower 130 is an extension connected to clamp jaw driver 35 and extends into inclined slot 124 of the cam hub. Upon rotation of the cam hub, the cam follower follows the slot and acts to either displace the clamp jaw driver and attached clamp jaw either inwardly or outwardly to either engage or disengage the paper roll as desired.

The entire robot assembly is mounted on linear bearings and rollers 37 for left-to-right displacement as may be seen at FIG. 1. A frame supports the robot assembly from the bearings and rollers 37.

Air cylinder 110 is provided having piston 112 slidably connected to yoke 114 which is attached to spindle 134. When it is desired to either secure a roll of paper from the conveyor belt or to place a roll of paper on the core latch of the paper payoff assembly the spindle is advanced to the desired position by displacing the spindle from the frame in the robot assembly. The air cylinder is actuated to drive piston 112 either to the left or to the right and yoke 114 acts to displace the spindle an equivalent distance.

Drive motor 118 is shown connected to drive gear 126 which is connected via belt 127 to driven gear 128 connected to drive shaft 38 of the spindle. Drive motor 118 acts to rotate the entire spindle to the desired position relative to either removing a paper roll from the conveyor belt or placing the paper roll in position on the paper payoff assembly. Drive shaft 38 is supported for rotational and sliding movement by bearing 116 within the frame of the robot assembly.

Additionally connected to the robot assembly and extending therefrom in any desired direction is detector frame 146. Detector frame 146 includes a light sensing detector 140 and a metal detector 142 mounted at the end thereof and positioned next to the paper roll. The light sensing detector is utilized to detect a predetermined printed mark placed on a paster tab securing the loose end of the paper roll in position. By sensing the position of this printed mark the paper roll may be positioned as desired when mounted on the paper payoff assembly. Metal detector 142 is utilized to determine the location of a clamp jaw arm such that they are radially located in a "safe range" for either pick-up of a roll from a conveyor or (in combination wih the light sensor) in a safe-range to place the roll on the core chuck.

Referring now to FIGS. 5 through 7 the paster tab and the manner of its use are more accurately described. FIG. 5 is a top view of paster tab 260 showing a tab made from a paper-type material having an upstream section 272 and a downstream section 274. The paster tab 260 includes a printed dark portion 262, two sets of lineal perforations 268 defining a generally triangular portion and a cut and removed triangle 269. Hence, a portion of the paster tab is removed to promote tearing of the paster tab along perforations 268.

FIG. 6 is a side view of the same paster tab. Therein paster tab 260 is shown having dark printed line 262 on the top thereof in the downstream portion and adhesive 264 on the bottom thereof. Adhesive 266 is placed at the top of the upstream portion 272. The manner of use of the particular adhesives and the tearaway portion will be described relative to FIG. 7.

FIG. 7 is a cutaway side view of the connection between the end of expiring ribbon 276 and the new paper roll. The new paper roll consists of the end of the new roll 280 and a first layer 278. The paster tab is utilized to secure the end of the paper roll to prevent it from unwinding prior to the paper roll being placed on the conveyor belt. The paster tab is secured to the paper roll with the adhesive 266 located on the top side of the upstream section of the paster tab being secured to the bottom of the end of the beginning of the new roll 280. The adhesive 264 located on the bottom of the downstream section of the paster tab is secured to the top of first layer 278 of the roll. Hence, the paster tab is located between the bottom surface of the end of the first layer in the new roll and the top surface of the immediately adjacent layer. In this manner the paper roll is prevented from unwinding. Additionally in this manner the dark printed section is secured between the beginning of the new roll 280 and the first layer of the old roll 278. Additionally, this dark portion is located upstream from where the end of the beginning of the new roll terminates such that it is optically visible to a detector.

The robot assembly includes an optical detector for detecting this printed stripe. The robot assembly acts to rotate the paper roll until the optical detector detects the printed strip to place the paper roll in the desired position such that the paster arm will act to paste the trailing edge of the old roll onto the appropriate portion of the new roll.

The invention has been described with reference to a particular embodiment. It is to be understood by those skilled in the art that variations and modifications can be made within the spirit and scope of the invention.

What is claimed is:

1. A roll transfer robot for transferring a roll of ribbon material having an outside diameter and an annular core from an unloading position of a conveyor assembly to a chuck means of a payoff assembly which comprises:

frame means suporting a spindle assembly for both rotational and sliding displacement;

locomotion means for displacing the robot between a first position in registration with the unloading position of the conveyor assembly and a second position in registration with the chuck means of the payoff assembly;

rotating means connected to the spindle assembly for effecting rotation thereof;

sliding means connected to the spindle assembly for effecting sliding displacement of the spindle assembly relative to the frame means;

means connected to the spindle assembly for releasably gripping the roll about its exterior diameter such that the paper roll may be rotated and slidably displaced with the spindle assembly; and means for detecting the position of the beginning end of a roll such that the roll may be oriented as desired when placed on the payoff assembly, said means for detecting including means for energizing the rotating means until the means for detecting detects the position of the beginning end of the roll.

2. The apparatus as set forth in claim 1 wherein the roll includes a marked portion of its exterior diameter surface and wherein the means for detecting includes an optical sensor capable of detecting the marked portion.

3. The apparatus as set forth in claim 2 wherein the means for detecting further comprises a metal detector and wherein the means for gripping the roll includes a clamp jaw extending across the outside diameter of the roll wherein said metal detector indicates that said clamp jaw is appropriately rotationally positioned to grip or release the roll of material.

4. The apparatus as set forth in claim 1 wherein the means for gripping the roll further comprises:

a plurality of clamp jaws positioned to be displaced radially inwardly and outwardly for gripping and releasing the exterior surface of a paper roll;

a plurality of clamp jaw drivers one attached to each clamp jaw for effecting displacement of the clamp jaws; and means for simultaneously displacing the clamp jaw drivers.

5. The apparatus as set forth in claim 4 wherein the means for simultaneously displacing the clamp jaw drivers comprises:

a cam hub mounted about the spindle for rotational movement in respect thereto, said cam hub defining a series of inclined slots;

said clamp jaw drivers each including a cam follower extending into an inclined slot of the cam hub; and an actuator for rotating the hub to cause the cam follower to follow the inclined slot thereby displacing the clamp jaws.

6. The apparatus as set forth in claim 4 wherein the spindle assembly further comprises:

radially extending arms, each arm including guide means for securing the clamp jaw drivers for radial displacement; and spacer means located between the arms and the radially extending surface of the roll.

7. A method of transferring a roll including an annular core from an unloading position of a conveyor assembly to a chuck means of a payoff assembly utilizing a robot assembly having adjustable roll clamping jaws which comprises the steps of:

positioning the robot assembly in registration with the unloading position of the conveyor assembly;

extending the spindle and gripping the roll with the roll clamping jaws;

retracting the spindle with the new roll to remove the roll from the conveyor assembly;

traversing to the payoff assembly and repositioning the robot assembly in registration with the payoff assembly;

rotating the clamping jaws to rotate the roll into a desired orientation;

placing the roll in position for a core chuck of the payoff assembly to engage the roll core;

holding the roll on the core chuck during the paster cycle;

releasing the roll clamping jaws to release the roll; and sensing the position of the paper roll to indicated to the step of rotating the desired orientation of the roll.

8. The method as set forth in claim 7 wherein the roll includes a mark on the exterior surface and wherein the step of sensing further comprises the steps of:

optically detecting the presence of the mark; and sensing the presence of a roll claming jaw whereby between these two steps the presence of the mark alone may be indicated.

9. The method as set forth in claim 7 including an actuator for displacing a cam hub defining an inclined slot and a clamping jaw driver having a cam follower secured in the inclined slot the cam hub and wherein the step of gripping includes energizing the actuator to displace the clamp jaws inwardly to secure the roll and the step of releasing includes energizing the actuator to displace the clamp jaws outwardly to release the roll.

* * * * *